US005449111A

United States Patent [19]

Sauzedde et al.

[11] Patent Number: 5,449,111

[45] Date of Patent: Sep. 12, 1995

[54] MAILBOXES WITH FRONT AND BACK DOORS AND A FLOOR WITH PLURAL ANGLED SURFACES

[76] Inventors: Rene J. Sauzedde, 2131 Kemp Rd.; Jerry Doe, Sprayberry Branck; Sandy Plains Rd., both of Marietta, Ga. 30066

[21] Appl. No.: 239,449

[22] Filed: May 9, 1994

[51] Int. Cl.[6] ..... B65D 91/00

[52] U.S. Cl. ..... 232/17; 232/43.4

[58] Field of Search ..... 232/17, 38, 43.4

[56] References Cited

U.S. PATENT DOCUMENTS

| | | | |
|---|---|---|---|
| 1,992,640 | 2/1935 | Steen | 232/17 |
| 3,106,335 | 10/1963 | Allen | 232/17 |
| 4,026,461 | 5/1977 | Hodge | 232/17 |
| 4,114,800 | 9/1978 | Hodge | 232/17 |
| 4,627,566 | 12/1986 | Fibus | 232/17 |
| 4,712,731 | 12/1987 | Gramelspacher | 232/17 |
| 4,905,891 | 3/1990 | Wildish | 232/17 |

FOREIGN PATENT DOCUMENTS

| | | | |
|---|---|---|---|
| 2495921 | 1/1982 | Germany | 232/17 |

*Primary Examiner*—Flemming Saether

[57] ABSTRACT

A mailbox with front and back doors and floor with angled surfaces comprising: a floor panel adapted to be supported in a horizontal plane by a post, the panel having long side edges and short front and back edges; an upper portion formed with parallel side walls extending upwardly from the side edges of the floor panel and curved in a semi-cylindrical configuration along the length of the floor panel, a forward extension and a rearward extension constructed as extensions of the front and rear edges of the upper portion at the front and back portion of the upper portion, the extension portions being formed of a curve slightly reduced with respect to the upper portion and having an upwardly extending projection on the upper surface thereof; and a front door and a back door, each door being formed of a planar section with parallel sides and a semi-circular upper curve corresponding in shape to the upper portion, the door including an inwardly extending lip positionable between an opened position wherein the door is essentially parallel with the floor panel and a closed position wherein the interior surface of the lip is in frictional contact with the projection and hinge means coupling the lower extent of each door with the lower extent of the upper portion at the front and the back.

3 Claims, 4 Drawing Sheets

MAILBOXES WITH FRONT AND BACK DOORS AND A FLOOR WITH PLURAL ANGLED SURFACES

BACKGROUND OF THE INVENTION

1. Field of the Invention

The present invention relates to mailbox with front and back door and floor with plural angled surfaces and more particularly pertains to facilitate the retrieving of mail deposited in a front door with forwardly angled surfaces and for retrieving the mail from the back door.

2. Description of the Prior Art

The use of mailboxes with one or more doors is known in the prior art. More specifically, mailboxes with one or more doors heretofore devised and utilized for the purpose of for the purpose of depositing and retrieving mail from either the front or the back of the mailbox are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,005,816 a mailbox having dual access closures and signal means.

U.S. Pat. No. 4,220,278 discloses a double door mailbox.

U.S. Pat. No. 4,382,540 discloses a double-door security rural mailbox.

U.S. Pat. No. 4,757,942 discloses a double door mailbox.

U.S. Pat. No. Des. 324,444 discloses the design of a two-way mailbox.

In this respect, the mailbox with front and back door and floor with plural angled surfaces according to the present invention substantially departs from the conventional concepts and designs of the prior art, and in doing so provides an apparatus primarily developed for the purpose of to facilitate the retrieving of mail deposited in a front door with forwardly angled surfaces and for retrieving the mail from the back door.

Therefore, it can be appreciated that there exists a continuing need for new and improved mailbox with front and back door and floor with plural angled surfaces which can be used for to facilitate the retrieving of mail deposited in a front door with forwardly angled surfaces and for retrieving the mail from the back door. In this regard, the present invention substantially fulfills this need.

SUMMARY OF THE INVENTION

In view of the foregoing disadvantages inherent in the known types of mailboxes with one or more doors now present in the prior art, the present invention provides an improved mailbox with front and back door and floor with plural angled surfaces. As such, the general purpose of the present invention, which will be described subsequently in greater detail, is to provide a new and improved mailbox with front and back door and floor with plural angled surfaces and method which has all the advantages of the prior art and none of the disadvantages.

To attain this, the present invention essentially comprises a new and improved mailbox with front and back doors and floor with angled surfaces comprising, in combination: a floor panel adapted to be supported in a horizontal plane by a post, the panel having long side edges and short front and back edges; an upper portion formed with parallel side walls extending upwardly from the side edges of the floor panel and curved in a semi-cylindrical configuration along the length of the floor panel, a forward extension and a rearward extension constructed as extensions of the front and rear edges of the upper portion at the front and back portion of the upper portion, the extension portions being formed of a curve slightly reduced with respect to the upper portion and having an upwardly extending projection on the upper surface thereof; a front door and a back door, each door being formed of a planar section with parallel sides and a semi-circular upper curve corresponding in shape to the upper portion, the door including an inwardly extending lip positionable between an opened position wherein the door is essentially parallel with the floor panel and a closed position wherein the interior surface of the lip is in frictional contact with the projection; hinge means coupling the lower extent of each door with the lower extent of the upper portion at the front and the back; a plurality of planar strips several times wider than the length positioned transversely across the upper surface of the floor panel to constitute a floor, the strips being angled forwardly toward the front door away from the back door to urge mail deposited therein toward the front door and preclude inadvertent movement toward the back door after the mail has been deposited and the front door closed; and a flag mounted exteriorly on one side wall of the upper portion to indicate when raised that mail is to be picked up and to indicate when lowered that mail is not be picked up.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved mailbox with front and back door and floor with plural angled surfaces which have all the advantages of the prior art mailboxes with one or more doors and none of the disadvantages.

It is another object of the present invention to provide new and improved mailbox with front and back door and floor with plural angled surfaces which may be easily and efficiently manufactured and marketed.

It is further object of the present invention to provide new and improved mailbox with front and back door and floor with plural angled surfaces which are of durable and reliable constructions.

An even further object of the present invention is to provide new and improved mailboxes with front and back door and floor with plural angled surfaces which are susceptible of a low cost of manufacture with regard to both materials and labor, and which accordingly are then susceptible of low prices of sale to the consuming public, thereby making such mailbox with front and back door and floor with plural angled surfaces economically available to the buying public.

Still yet another object of the present invention is to provide new and improved mailboxes with front and back door and floor with plural angled surfaces which provide in the apparatuses and methods of the prior art Some of the advantages thereof, while simultaneously overcoming some of the disadvantages normally associated therewith.

Still another object of the present invention is to facilitate the retrieving of mail deposited in a front door with forwardly angled surfaces and for retrieving the mail from the back door.

Lastly, it is an object of the present invention to provide new and improved mailbox with front and back doors and floor with angled surfaces comprising: a floor panel adapted to be supported in a horizontal plane by a post, the panel having long side edges and short front and back edges; an upper portion formed with parallel side walls extending upwardly from the side edges of the floor panel and curved in a semi-cylindrical configuration along the length of the floor panel, a forward extension and a rearward extension constructed as extensions of the front and rear edges of the upper portion at the front and back portion of the upper portion, the extension portions being formed of a curve slightly reduced with respect to the upper portion and having an upwardly extending projection on the upper surface thereof; and a front door and a back door, each door being formed of a planar section with parallel sides and a semi-circular upper curve corresponding in shape to the upper portion, the door including an inwardly extending lip positionable between an opened position wherein the door is essentially parallel with the floor panel and a closed position wherein the interior surface of the lip is in frictional contact with the projection and hinge means coupling the lower extent of each door with the lower extent of the upper portion at the front and the back.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
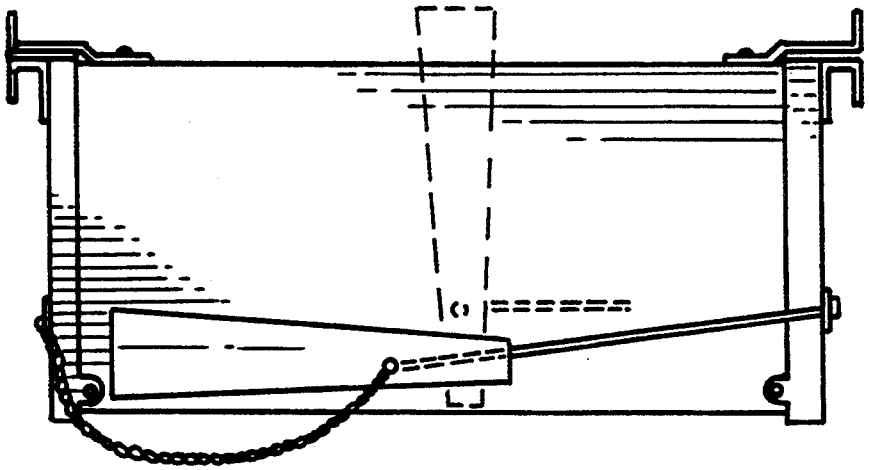
FIG 1 PRIOR ART
FIG. 1 is a side elevational view of one type of prior art mailbox with front and back doors.
Figure 2:
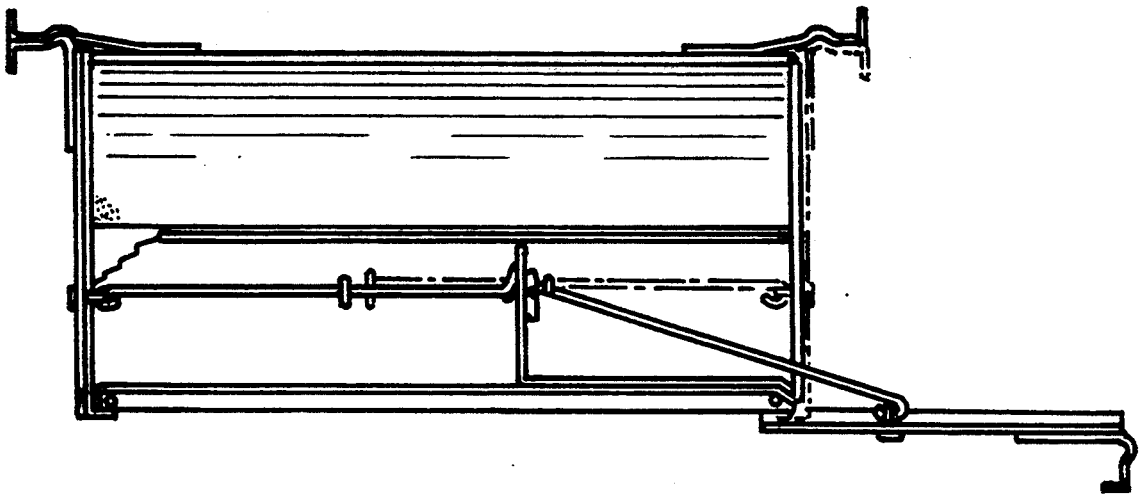
FIG 2 PRIOR ART
FIG. 2 is a side elevational view of another prior art mailbox with a front and a back door.
Figure 3:
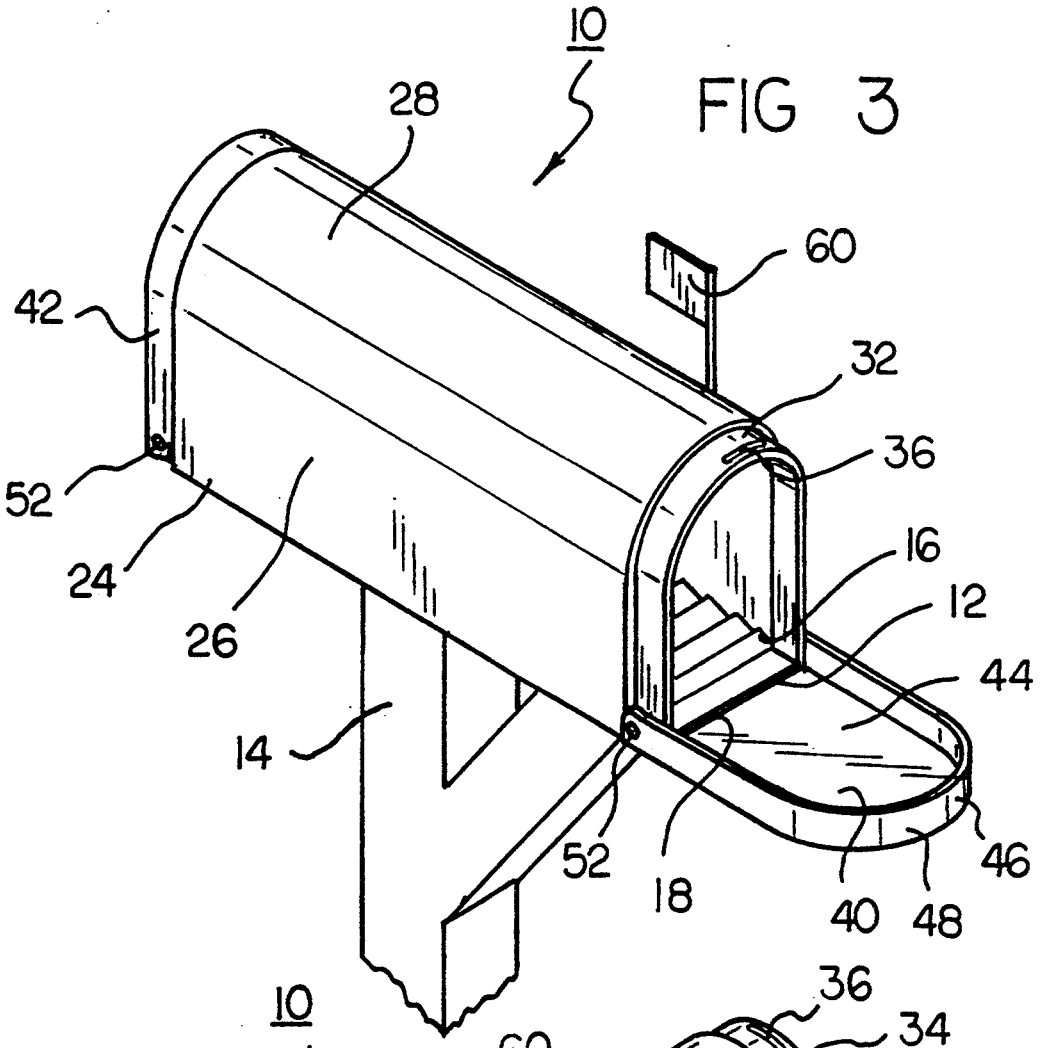
FIG. 3 is a perspective illustration of the preferred embodiment of the new and improved mailbox constructed in accordance with the principles of the present invention.
Figure 4:
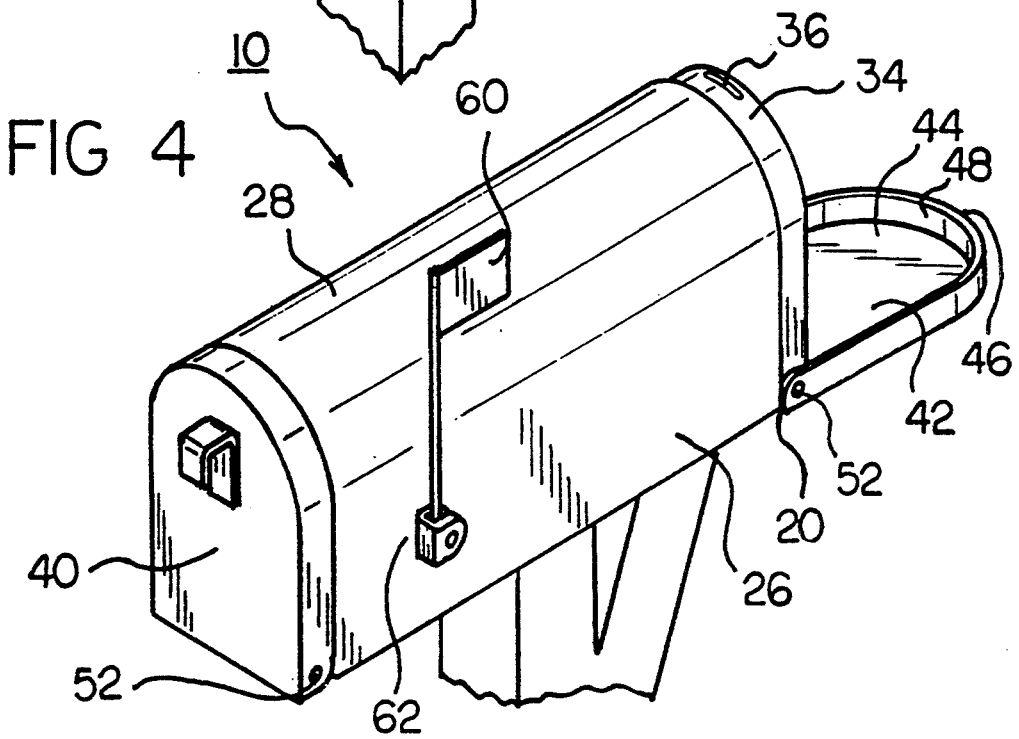
FIG. 4 is a perspective illustration of the mailbox shown in FIG. 3 but shown from the opposite side thereof.
Figure 5:
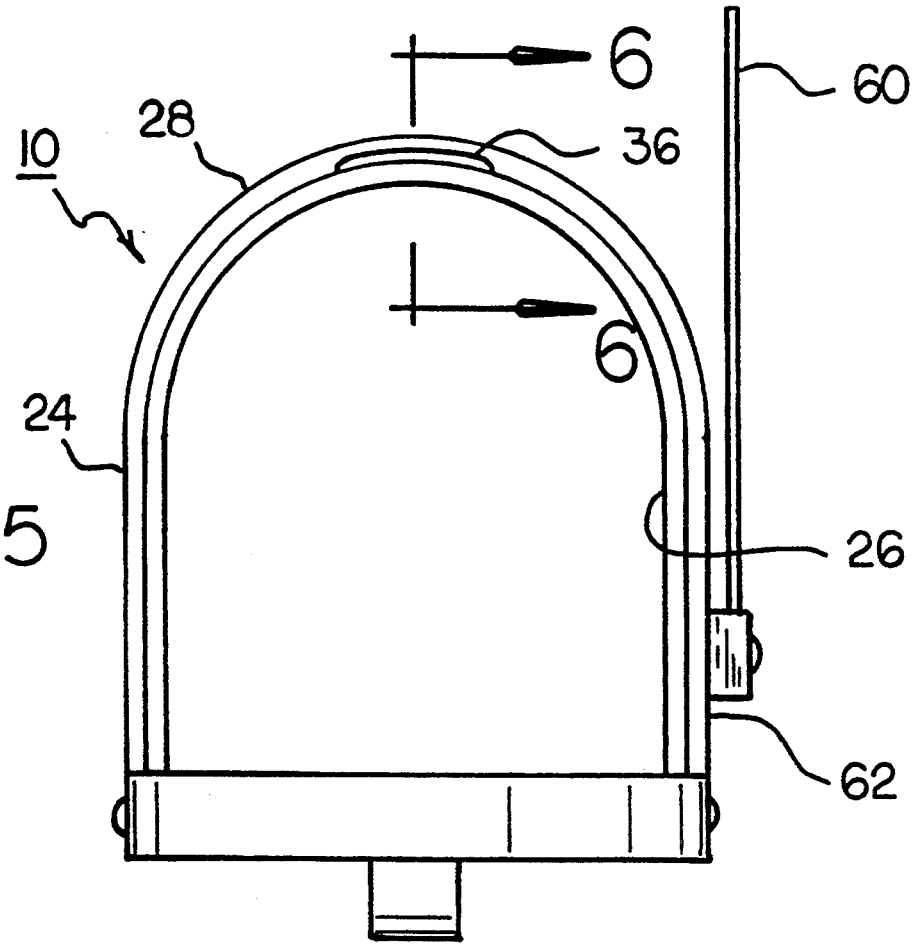
FIG. 5 is a front elevational view of the mailbox of the prior Figures taken with the door open.
Figure 6:
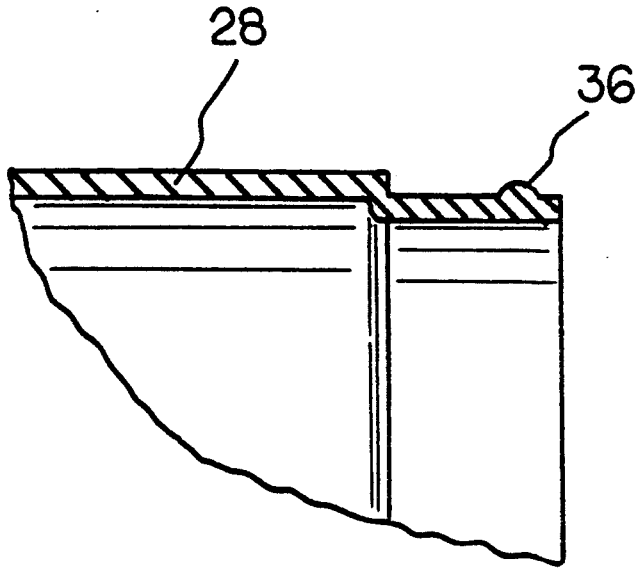
FIG. 6 is a cross-sectional view of the mailbox of the prior Figures taken along lines 6—6 of FIG. 5.
Figure 7:
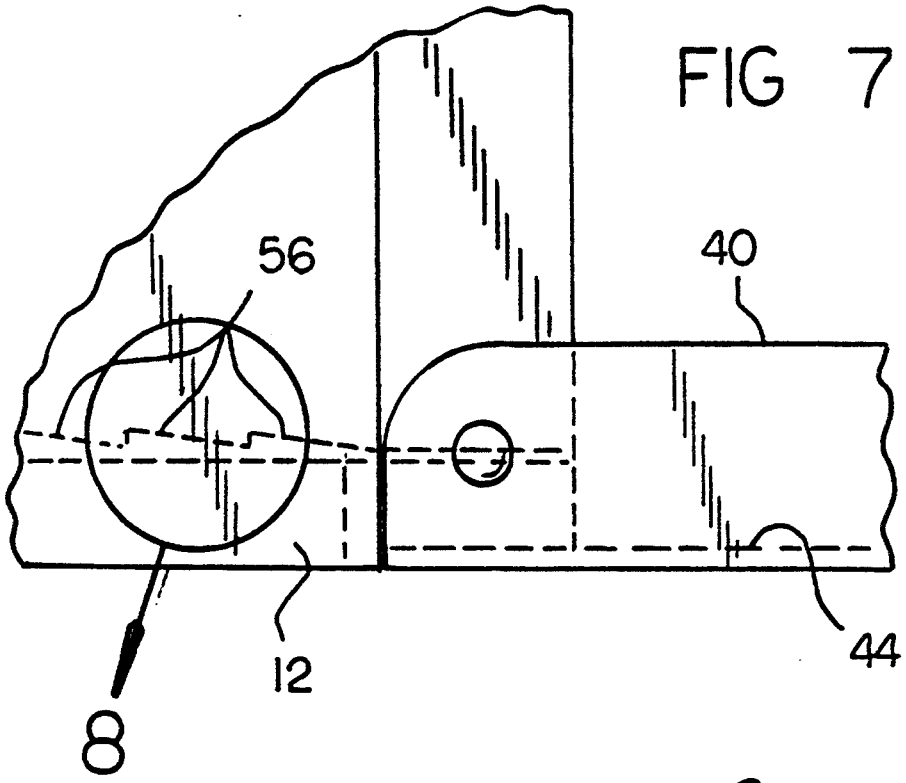
FIG. 7 is a side elevational view of the hinge mechanism for the mailbox of the prior Figures and illustrating the upper surface of the floor thereof.
Figure 8:
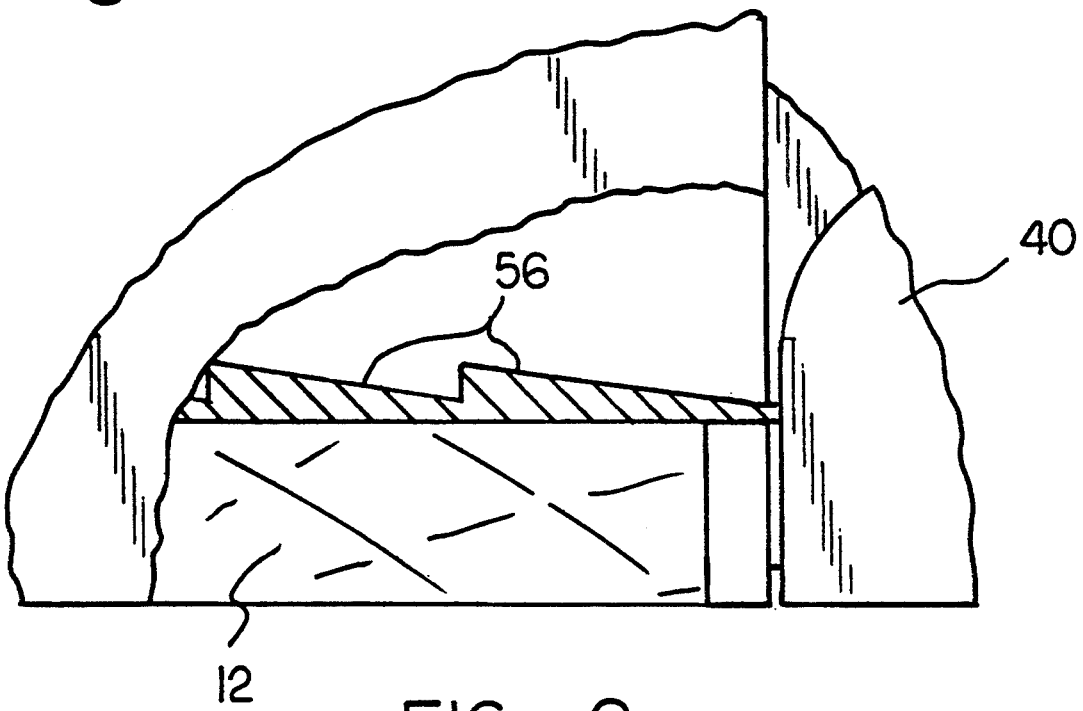
FIG. 8 is an enlarged side elevational view with parts removed to show internal constructions taken about circle 8 of FIG. 7.

With reference now to the drawings, and in particular to FIG. 1 thereof, the preferred embodiment of the new and improved mailbox with front and back door and floor with plural angled surfaces embodying the principles and concepts of the present invention and generally designated by the reference numeral 10 will be described.

The present is comprised of a plurality of components. In their broadest context, the components include a conventional mailbox with a floor panel, an upper portion, a front door and a back door, a plurality of planar strips and a flag. Such components are specifically configured and correlated with respect to each other so as to attain the desired objective.

More specifically, the mailbox 10 is comprised of a floor panel 12. The floor panel is adapted to be supported in the horizontal plane by a post 14. The panel has long side edges 16 and a short front edge 18 and a back edge 20.

The mailbox also has an upper portion 24. The upper portion is formed with parallel side walls 26 extending upwardly from the side edges of the floor panel. The upper portion also has a curve 28 in a semi-circular configuration along the length of the floor panel.

A forward extension 32 and a rearward extension 34 are constructed as extensions of the front and rear edges of the upper portion at the front and back portions of the upper portion. The extension portions are formed with a curve and sides slightly reduced with respect to the upper portion. Such extensions include an upwardly extending projection 36 on the upper surfaces thereof.

Next provided are a front door 40 and a back door 42. Such doors are of a similar construction. Each door is formed with a planar section 44. The planar section has parallel sides and a semi-circular upper curve 46 corresponding in shape to the upper portion. The door also includes an inwardly extending lip 48 positionable between an open position wherein the door is essentially parallel with the floor panel. The door is also movable to a closed position wherein the interior surface of the lip is in frictional contact with the projection.

Next provided is a hinge 52. The hinge is located at the lower extent of the side panel at the front and rear. It is coupled to the lower extent of the doors for coupling therebetween.

Next provided are a plurality of planar strips 56. Such strips are several times wider than their length. The strips are positioned transversely across the upper surface of the floor panel. The strips thus constitute the actual floor of the mailbox. The strips are angled forwardly toward the front door away from the back door. The strips thus tend to urge any mail deposited thereupon toward the front door while lying in a horizontal plane. Deposited mail does not stand at an angle upon the strips. Rather, mail lies upon the strips in a generally horizontal orientation. The strips cause the mail to tilt slightly forward in a generally horizontal orientation. This will preclude inadvertent movement of deposited mail toward the back door after the mail has been deposited and the front door has been closed.

Lastly provided is a flag 60. The flat is mounted exteriorlly on one side wall 62 of the upper portion. The flag functions to indicate that mail is to be picked up when the flag is raised. The flag is also positionable in a lower orientation. In such orientation, an indication is made that mail is not to be picked up.

The present invention is a very practical solution to many of the concerns that people have about mailboxes in general. The complaints are rarely ever heard, but inherently, many people dislike stepping out into the street or highway to open the box to reach the mail. The box is usually located close to the curb so the mail can be delivered from within a vehicle. While this is a great convenience to the postal system, it is somewhat hazardous to the resident. Elderly, feeble, and disabled people dislike subjecting themselves to any such danger because they may not be able to react swiftly enough if a vehicle passes by very closely to them. Parents are also concerned about young children who go out onto the street to open the box. In addition to these dangers, walking to the front of the box is a waste of effort. If the door was in the back of the box, it would not even be necessary to leave the yard.

The present invention has a door in the back as well as the front of the mailbox. It eliminates all of the problems associated with boxes that open in the front only. This is a very simple and practical solution to a problem that applies to millions of mailboxes. The slight additional cost is more than offset by the safety and peace of mind that it provides.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved mailbox with front and back doors and a floor with angled surfaces comprising, in combination:

a floor panel adapted to be supported in a horizontal plane by a post, the panel having long side edges and short front and back edges;

an upper portion having front and back sections, the upper portion formed with parallel side walls extending upwardly from the side edges of the floor panel and curved in a semi-cylindrical configuration along the length of the floor panel, a forward extension and a rearward extension constructed as extensions of the front and rear edges of the floor panel and the front and back sections of the upper portion, the extensions being formed as having generally the same transverse cross-sectional shape as the upper portion but of slightly reduced dimensions with respect to the upper portion and having an upwardly extending projection on a upper surface thereof;

a front door and a back door, each door being formed of a planar section with parallel sides and a semi-circular upper curve corresponding in shape to the upper portion, the door including an inwardly extending lip positionable between an opened position wherein the door is essentially parallel with the floor panel and a closed position wherein the lip is in frictional contact with the projection;

hinge means coupling a lower extent of each door with a lower extent of each extension at the front and the back;

a plurality of planar strips several times wider than in length positioned transversely across a upper surface of the floor panel to constitute a floor, the strips being angled downwardly and forwardly toward the front door away from the back door, the floor urging mail deposited thereupon toward the front door, while lying in a horizontal plane, the floor precluding inadvertent movement of the mail toward the back door after the mail has been deposited and the front door closed; and a flag mounted exteriorly on one side wall of the upper portion to indicate when raised that mail is to be picked up and to indicate when lowered that mail is not to be picked up.

2. A mailbox with front and back doors and floor with angled surfaces comprising:

a floor panel adapted to be supported in a horizontal plane by a post, the panel having an upper surface, a lower surface, long side edges and short front and back edges, the upper surface including means to urge mail toward the front edge while lying in a generally horizontal plane;

an upper portion having front and back sections, the upper portion formed with parallel side walls extending upwardly from the side edges of the floor panel and curved in a semi-cylindrical configuration along the length of the floor panel, a forward extension and a rearward extension constructed as extensions of the front and rear edges of the floor panel and the front and back sections of the upper portion, the extensions being formed as having generally the same transverse cross-sectional shape as the upper portion but of slightly reduced dimensions with respect to the upper portion and having an upwardly extending projection on a upper surface thereof;

a front door and a back door, each door being formed of a planar section with parallel sides and a semicircular upper curve corresponding in shape to the upper portion, the door including an inwardly extending lip positionable between an opened position wherein the door is essentially parallel with the floor panel and a closed position wherein the lip is in frictional contact with the projection and hinge means coupling a lower extent of each door with a lower extent of each extension at the front and the back; and a flag mounted exteriorly on one side wall of the upper portion to indicate when raised that mail is to be picked up and to indicate when lowered that mail is not to be picked up.

3. The device as set forth in claim 2 wherein the means to urge mail toward the front edge comprises a plurality of planar strips having a width several times wider than in length positioned transversely across the upper surface of the floor panel to constitute a floor, the strips being angled forwardly and downwardly toward the front door away from the back door, the floor urging mail positioned thereupon in a forward direction while lying in a horizontal plane, the floor also precluding inadvertent rearward movement of mail positioned thereupon.

* * * * *